US007774860B2

(12) United States Patent
Kohler

(10) Patent No.: US 7,774,860 B2
(45) Date of Patent: Aug. 17, 2010

(54) PROTECTIVE GLOVE WITH INDEPENDENT PADS

(75) Inventor: Dale W. Kohler, Hunt Valley, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 100 days.

(21) Appl. No.: 12/115,064

(22) Filed: May 5, 2008

(65) Prior Publication Data

US 2008/0209607 A1 Sep. 4, 2008

Related U.S. Application Data

(63) Continuation of application No. 11/067,742, filed on Mar. 1, 2005, now Pat. No. 7,370,373.

(51) Int. Cl.
*A41D 19/00* (2006.01)

(52) U.S. Cl. ..... 2/161.1

(58) Field of Classification Search ..... 2/16, 2/20, 161.1, 161.6
See application file for complete search history.

(56) References Cited

U.S. PATENT DOCUMENTS 4,411,024 A 10/1983 Hayes
4,930,162 A 6/1990 Cote
5,067,175 A 11/1991 Gold
5,214,799 A * 6/1993 Fabry ..... 2/161.6
5,274,846 A * 1/1994 Kolsky ..... 2/460
5,345,609 A * 9/1994 Fabry et al. ..... 2/20
5,511,242 A 4/1996 Bianchi
5,511,243 A 4/1996 Hall et al.
5,640,712 A 6/1997 Hansen et al.
5,787,506 A 8/1998 Wilder et al.
6,085,354 A 7/2000 Wilder et al.
6,122,769 A 9/2000 Wilder et al.
6,550,069 B1 4/2003 Morrow
6,704,939 B2 3/2004 Faulconer
7,000,259 B2 2/2006 Matechen
2003/0188373 A1 * 10/2003 Garneau ..... 2/161.1

* cited by examiner

*Primary Examiner*—Katherine Moran
(74) *Attorney, Agent, or Firm*—Paul, Hastings, Janofsky & Walker LLP

(57) ABSTRACT

A protective glove having an elastic substrate, a first pad segment attached to the elastic substrate, and a second pad segment attached to the elastic substrate independently from the first pad segment. The elastic substrate can be disposed over an area intended to substantially cover a forearm, a wrist, a back of a hand, a finger, and/or a thumb of a user wearing the glove. The elastic substrate can be stretchable in different directions and to different degrees in the areas around each pad segment, thereby enabling independent movement of the individually attached pad segments to accommodate any number of contours and flex points. Other embodiments provide methods for manufacturing a protective glove having independent pads.

22 Claims, 8 Drawing Sheets

PROTECTIVE GLOVE WITH INDEPENDENT PADS

This is a continuation of U.S. patent application Ser. No. 11/067,742, filed Mar. 1, 2005, now U.S. Pat. No. 7,370,373, which is herein incorporated by reference in its entirety.

BACKGROUND

1. Field of the Invention

The present invention relates generally to personal protective equipment and, in particular, to a protective sports glove having independent pads, for use in sports such as lacrosse, ice hockey, motorcross, skiing, snowboarding, bicycling, cricket, and field hockey.

2. Background of the Invention

Protective sports gloves, and particularly lacrosse gloves, typically provide thick padding over the back of a player's hand. In lacrosse, this padding protects the player's hands from the hard contact of other players' sticks, which often occurs during checking. However, recent improvements in lacrosse heads and pockets, which make ball dislodgement more difficult, have resulted in an increased level of physical play, as players check more forcefully in efforts to free the ball. In addition, modern athletes tend to be bigger and stronger, increasing the physicality of games such as lacrosse and ice hockey. The protection afforded by the glove padding is therefore now more critical than it has ever been. Increasing the thickness of the padding can help, but often detracts from the comfort and maneuverability of the glove. In addition to protection, players demand feel and flexibility from lacrosse gloves to enable precise stick handling. Thus, increased protection can often work at odds with comfort and maneuverability.

Some conventional lacrosse gloves, such as the glove 100 shown in FIG. 1, have pad segments (e.g., made of foam) that are covered with leather or synthetic leather and, in the valleys between the segments, are affixed to one another and to a backing material, such as a woven fabric. In these types of conventional gloves, individual pads are affixed to surrounding pads and to a solid backing by, for example, stitching, adhesives, high frequency welding, or other suitable attachment means. The glove 100 can have pads, for example, in the palm (not shown), the thumb (not shown), the fingers 150, the back hand area 152, the cuff roll 154 (e.g., protecting the wrist), and the cuff 156 (e.g., protecting the forearm).

FIG. 2 illustrates a cross-sectional view of the glove 100 of FIG. 1 along line A-A, showing covered pad segments that are stitched together and to a backing material. As shown, glove 100 includes pad segments 200, each of which has a pad core 202, a rigid inner cover 208, and an outer cover 204. The ends 206 of the outer covers 204 of adjacent pad segments 200 are overlapped and are stitched together and to a backing material 210.

The breaks between the pad segments are typically located to accommodate a flex point (e.g., the knuckles or finger joints) or contour (e.g., the shape of a closed first) of the hand. When a player wearing a conventional glove wraps his hand around a stick during play, the pad segments are all pulled away from each other, creating tension on the attached ends 206 and an uncomfortable resistance and stiffness. Increases in the thickness, size, and number of the pad segments or in the rigidity of the material from which the pad segments are made further exacerbate this problem.

BRIEF SUMMARY OF THE INVENTION

The present invention provides a protective glove having independent pads. Instead of affixing pad segments together, as is prevalent in the prior art, the present invention allows the pad segments to move completely independently from one another.

One embodiment of the present invention provides a protective glove having an elastic substrate, a first pad segment attached to the elastic substrate, and a second pad segment attached to the elastic substrate independently from the first pad segment. The elastic substrate can be disposed over an area intended to substantially cover a forearm, a wrist, a back of a hand, a finger, and/or a thumb of a user wearing the glove. The elastic substrate can be stretchable in different directions and to different degrees in the areas around each pad segment, thereby enabling independent movement of the individually attached pad segments to accommodate any number of contours and flex points.

In another embodiment, elastic material, such as spandex, replaces portions of the backing material at certain locations, and the individual pad segments are affixed to the elastic material substrate only. The elastic material can be attached to the backing material by, for example, stitching. In one embodiment, the pad segments cover the back of the hand, fingers, and thumb of a user wearing the glove.

In an alternative embodiment, elastic material covers portions of the backing material, rather than replacing portions. In this case, the pad segments can be attached to one or both of the elastic material and the backing material.

With the above constructions, the present invention provides a significantly more flexible glove. Rather than the pad segments pulling on and constraining one another during flexing, the pad segments move independently and, with the aid of the elastic material, eliminate the resistance and stiffness that is common in the prior art. The elastic material is able to stretch in different directions simultaneously and to different degrees in the areas around each pad segment, thereby enabling independent movement of the individually attached pad segments. Consequently, because the pad segments move independently from each other as the elastic material stretches, the glove of the present invention is able to accommodate any number of contours and flex points.

Other embodiments of the present invention provide methods for manufacturing a protective glove having independent pads.

DETAILED DESCRIPTION OF THE INVENTION

Figure 1:
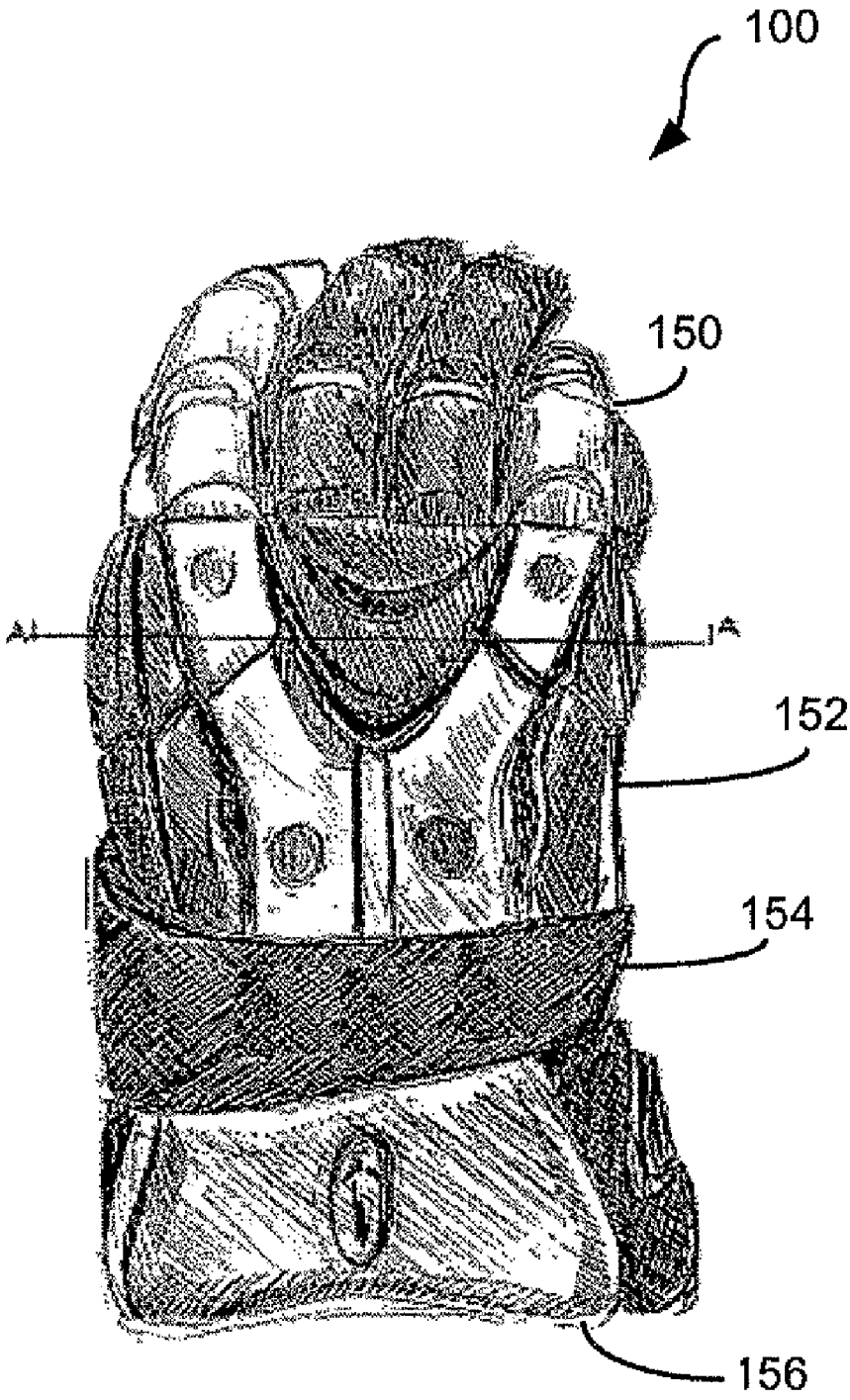
FIG. 1 [PRIOR ART]
FIG. 1 is a schematic diagram of a conventional lacrosse glove.
Figure 2:
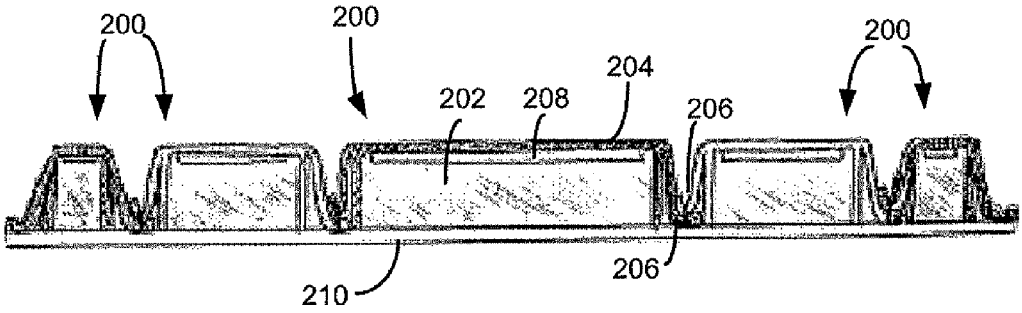
FIG. 2 [PRIOR ART]
FIG. 2 is a schematic diagram of a cross-sectional view of the lacrosse glove of FIG. 1 along line A-A.
Figure 3:
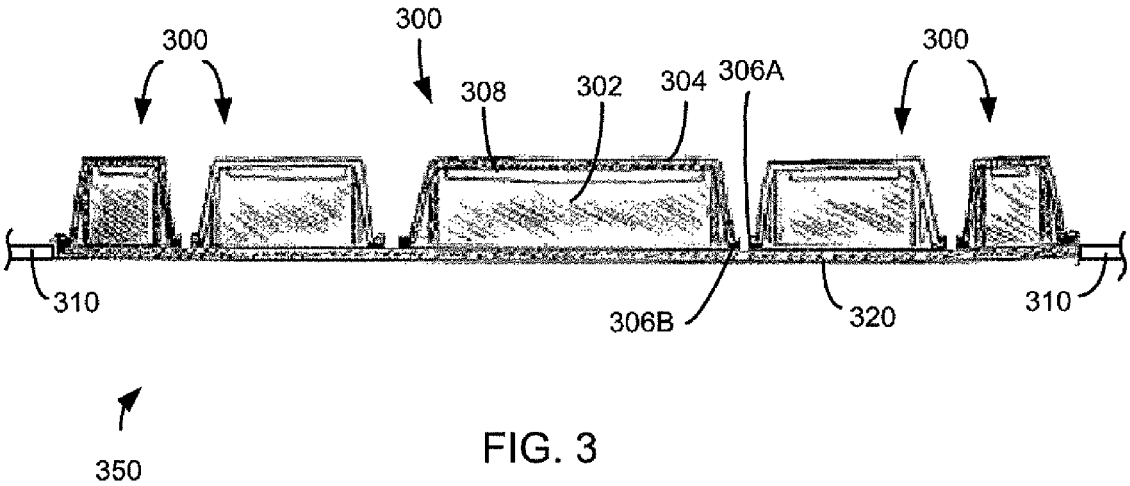
FIG. 3 is a schematic diagram of a cross-sectional view of an exemplary protective sports glove, according to an embodiment of the present invention.

FIG. 3 illustrates a cross-sectional view of an exemplary sports glove 350, according to an embodiment of the present invention. For illustrative purposes, this cross-sectional view corresponds generally to the cross-sectional view of FIG. 2. As shown in FIG. 3, the glove 350 of the present invention can include a plurality of pad segments 300, an elastic substrate 320, and a backing material 310. Each pad segment 300 can include a pad core 302 and an outer cover 304, and preferably a rigid inner cover 308 that provides shape and support for the outer cover 304. The plurality of pad segments 300 is disposed on and attached to the elastic substrate 320. The elastic substrate 320 can be attached to the backing material 310 over an opening in the backing material 310.

According to an embodiment of the present invention, each of the pad segments 300 is independently attached to the elastic substrate 320. Thus, unlike prior art protective sports gloves, the pad segments 300 are not attached directly to each other (as shown, for example, by the directly attached ends 206 of the outer covers 204 in FIG. 2). As an example, as shown in FIG. 3, the end 306A of one pad segment 300 is attached to elastic substrate 320 and the end 306B of an adjacent pad segment 300 is attached to elastic substrate 320, without having ends 306A and 306B attached directly to each other. The ends 306A and 306B are preferably stitched to the elastic substrate 320, but could, of course, be attached by other means such as an adhesive. In an embodiment of the invention, each pad segment is spaced apart from adjacent pad segments, such that a separation or air space exists between adjacent pad segments.

Elastic substrate 320 is preferably able to stretch differently in the area of each pad segment 300 to accommodate the independent and different relative movements of the pad segments 300. For example, elastic substrate 320 may stretch more in the area of a pad segment 300 that covers a flex point of the hand and less in the area of a pad segment 300 that covers a flat portion of the hand. In addition, elastic substrate 320 preferably stretches in any direction to allow the pad segments 300 to move in any direction independently from each other. In essence, the elastic substrate 320 enables the pad segments 300 to float freely over the area of the hand to be protected, without being restricted by each other or backing material 310.

Figure 4:
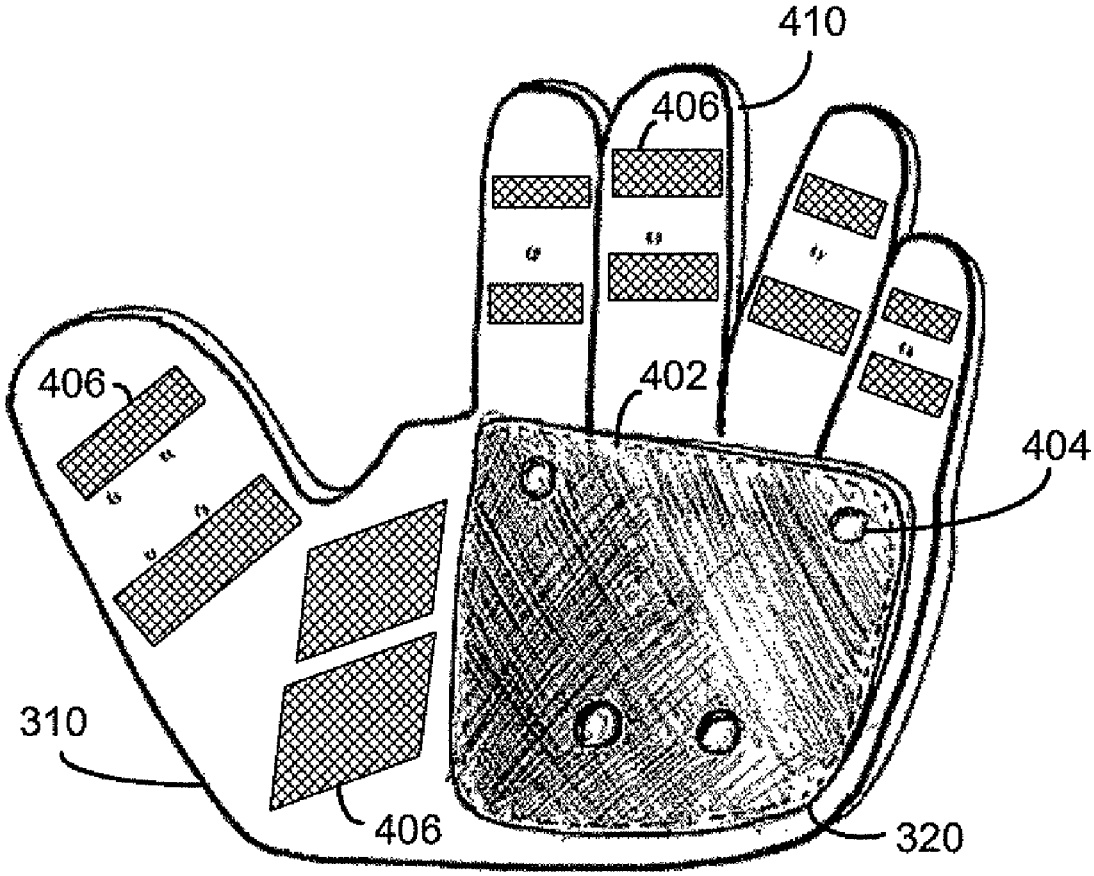
FIG. 4 is a schematic diagram of backing material of an exemplary protective sports glove, having elastic material over the area intended to cover the back of a user's hand, according to an embodiment of the present invention.

FIG. 4 illustrates a top view of the backing material 310 and elastic substrate 320 of FIG. 3, without the pad segments 300, according to an embodiment of the present invention. In this example, elastic substrate 320 is disposed over an opening in backing material 310 and is attached to backing material 310 by perimeter stitching 402, which runs in a line substantially around the perimeter of elastic substrate 320. Alternatively, elastic substrate 320 could be attached to backing material 310 by other point attachments (e.g., rivets or staples) or by continuous attachment means (e.g., a spray adhesive or an adhesive laminate).

Backing material 310 can also include a gusset 410 as shown in FIG. 4. Gusset 410 provides expansion and/or reinforcement in affixing backing material 310 to remaining portions of a glove.

The size, shape, and location of elastic substrate 320 depend on the area over which independent pad segment movement is desired and the particular flex points or contours that are accommodated. In the example of FIG. 4, elastic substrate 320 substantially covers the back of the hand and accommodates the various contours of the hand as the hand opens and closes.

In a further embodiment of the present invention, elastic substrate 320 includes openings 404 to provide means for ventilation from the inside to the outside of the glove. Openings 404 are capable of venting heat and moisture from below elastic substrate 320 (i.e., from the inside the glove) to above elastic substrate 320 (i.e., toward the outside of the glove).

Elastic substrate 320 can be made of any material capable of stretching in response to a pulling force and returning to substantially its original size and shape after the pulling force is removed. Preferably, the elastic material has this capability in response to a pulling force in any direction and to pulling forces in multiple directions simultaneously. Elastic substrate 320 could be a woven fabric, a non-woven fabric, a mesh, or other similar material. An example of a suitable elastic material is spandex (elastane) fiber material produced by, for example, Dorlastan Fibers and Monofil GmbH of Dormagen, Germany or INVISTA Inc. of Wichita, Kans. Other examples include Lycra from INVISTA, flexible polyurethane foam, and injection molded elastomeric materials.

In a further embodiment, backing material 310 or elastic substrate 320 can have a woven component such that one side is flocked or more woven-like, while the other side is more elastic or rubbery. The flocked side can be placed against a user's skin for better feel and comfort.

Backing material 310 can be made of any of the materials typically used for glove interiors, including woven and non-woven textile materials. Examples of suitable materials include nylon and performance fabrics. A performance fabric is an air permeable material that moves moisture away from the user's skin and dries quickly. An example of a suitable performance fabric is Cool Max™ produced by INVISTA of Wichita, Kans. Backing material 310 can also be stretchable.

Referring again to FIG. 3, the outer cover 304 of pad segments 300 can be made of a durable, water-resistant material, such as natural leather, double knit polyester, woven nylon cordura, or synthetic leather (e.g., polyurethane coated material or microleather).

Pad core 302 can be made of a soft, impact absorbing material such as open and closed cell ethylene vinyl acetate (EVA), IXPE foam, air chambers, and gels.

Rigid inner cover 308 can be made of a material that is stiffer than outer cover 304 and pad core 302. For example, suitable materials for rigid inner cover 308 include plastic, carbon fiber, or a metal such as titanium.

The stitching used to attach the components of glove 350 (such as stitching 402) can be a durable, water-resistant thread. For example, suitable thread material for the stitching includes nylon, natural fibers, and metallic threads.

In an alternative embodiment of the present invention, pad segments 300 are compression, injection, cast, or blow molded plastic. For example, instead of having a foam core covered with real or synthetic leather, each pad segment 300 could be a unitary molded piece that is affixed to the elastic substrate and/or backing material. These molded pieces could be shaped and sized accordingly to fit properly over corresponding portions of a glove, such as the palm, fingers, thumb, backhand area, cuff roll, and roll.

Figure 5:
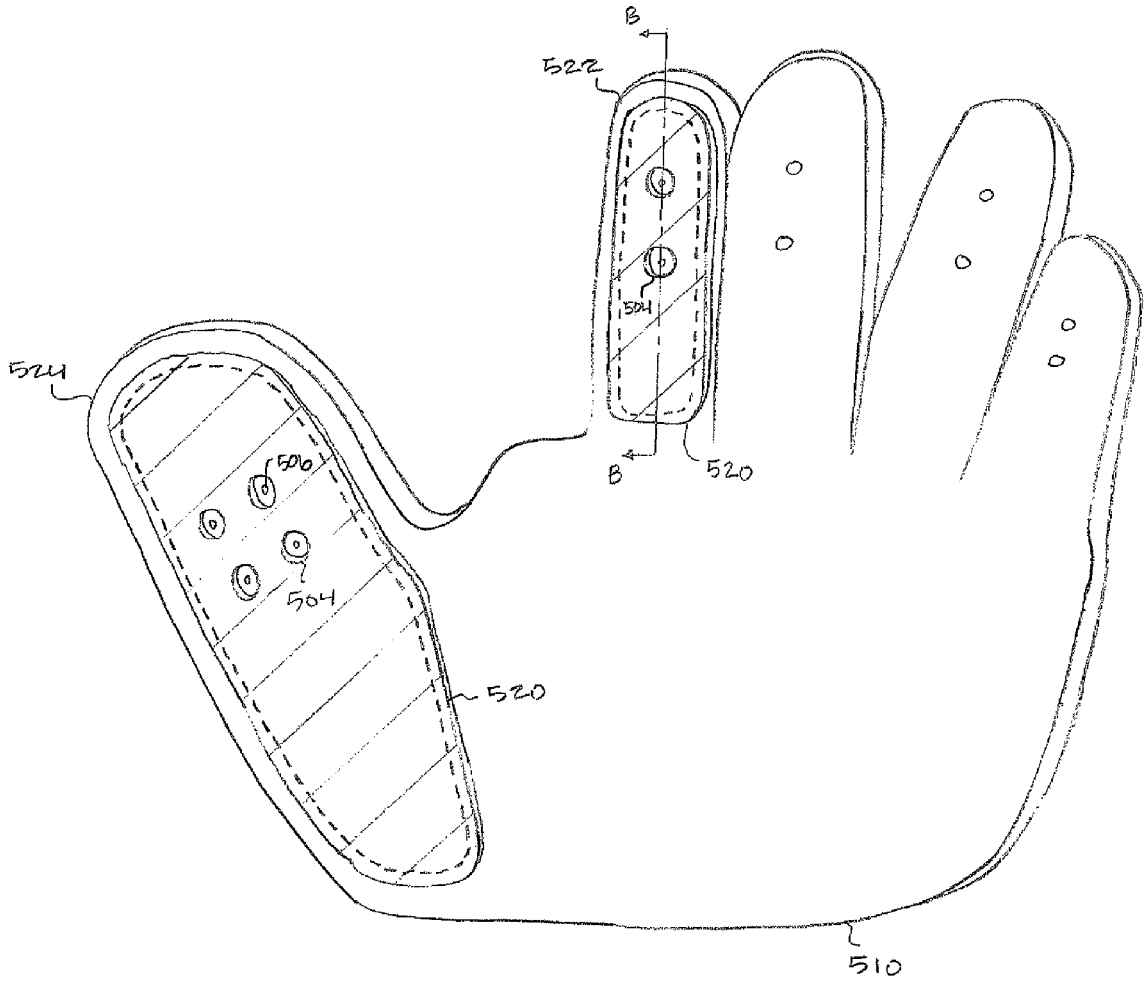
FIG. 5 is a schematic diagram of backing material of an exemplary protective sports glove, having elastic material on the area intended to cover the thumb and index finger of a user's hand, according to an embodiment of the present invention.

Although FIG. 4 shows elastic substrate 320 disposed in substantially the area of the back of the hand, elastic material could, of course, be applied to other regions of the glove to accommodate other flex points or contours, For example, additional areas 406 of elastic substrate can be provided in the thumb joint, thumb, fingers, cuff roll, and cuff. FIG. 5 shows others examples of elastic substrates 520 applied over openings in one or more individual fingers 522 or thumb 524 of a backing material 510. Optionally, the elastic substrate 520 includes ventilation openings 504 as described above. Backing material 510 can include corresponding ventilation openings 506 aligned with ventilation openings 504 in elastic substrate 520.

Figure 6A:
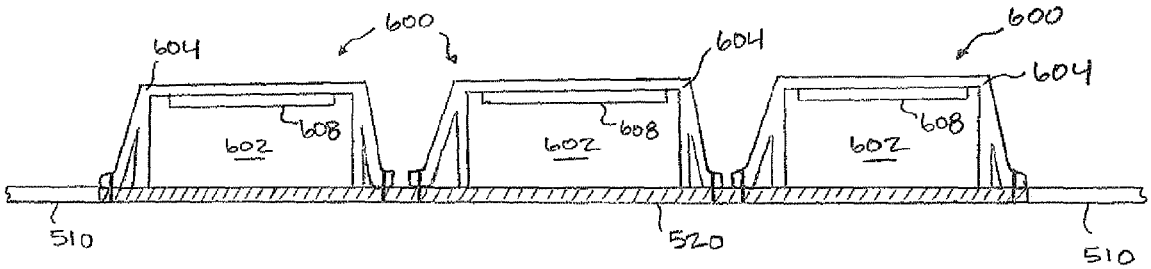
FIG. 6A is a schematic diagram illustrating a cross-sectional view of the index finger area of the backing material shown in FIG. 5 along line B-B, with an elastic material disposed over an opening in the backing material and with the pad segments shown, according to an embodiment of the present invention.

FIG. 6A illustrates a cross-sectional view of the index finger 522 of FIG. 5 along line B-B, with pad segments 600 shown, according to an embodiment of the present invention. In this example, three pad segments 600 are attached to the elastic substrate 520 of the index finger 522, to accommodate the knuckle and two joints of the finger. Pad segments 600 each include a pad core 602, a rigid inner cover 608, and an outer cover 604. The outer covers 604 are separately attached to elastic substrate 520 and are not attached to each other. In this manner, the pad segments 600 can move independently from each other in response to the flexing and changing contours of a finger in the glove. A pad segment configuration similar to that shown in FIG. 6A could be applied to the other fingers 522 and thumb 524 of backing material 510.

Figure 6B:
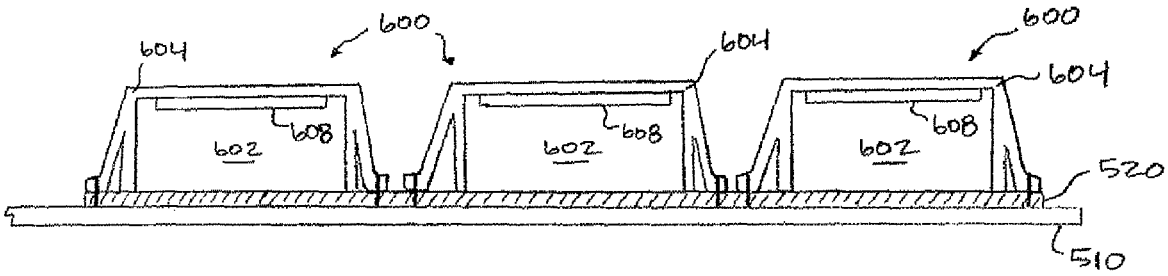
FIG. 6B is a schematic diagram of an alternative cross-sectional view of the index finger area of the backing material shown in FIG. 5 along line B-B, with an elastic material attached over the backing material, without an opening in the backing material, and with the pad segments shown, according to an alternative embodiment of the present invention.

FIG. 6B illustrates an alternative cross-sectional view of the index finger area of the backing material shown in FIG. 5 along line B-B, with the elastic substrate attached over the backing material, without an opening in the backing material, and with the pad segments shown, according to an alternative embodiment of the present invention. In this alternative embodiment, backing material 510 does not have an opening in which elastic substrate 520 is disposed (as in FIG. 6A). Instead, elastic substrate 520 is attached over backing material 510 itself. In one implementation, as shown in FIG. 6B, the ends of the pad segments 600 are attached to the elastic substrate 520 only and not to backing material 510, which maximizes the degree to which pad segments 600 can float. In an alternative implementation, the ends of pad segments 600 are attached to both the elastic substrate 520 and also the backing material 510 by, for example, stitching through the ends of pad segments 600, the elastic substrate 520, and the backing material 510.

In an alternative embodiment of the present invention, the elastic substrate is the backing material. For example, the elastic substrate can be in the shape of substantially the entire backing material 310 shown in FIG. 4, without requiring a separate backing material or the attachment of additional elastic substrates, such as elastic substrates 320 and 406. In this configuration, the elastic substrate, as an elastomeric or stretchable non-woven material, for example, could provide independent pad movement over substantially the entire area of the back of the glove.

In another alternative embodiment of the present invention, the independent pad construction is applied to other portions of a glove, such as the palm, cuff roll, and cuff.

Figure 7:
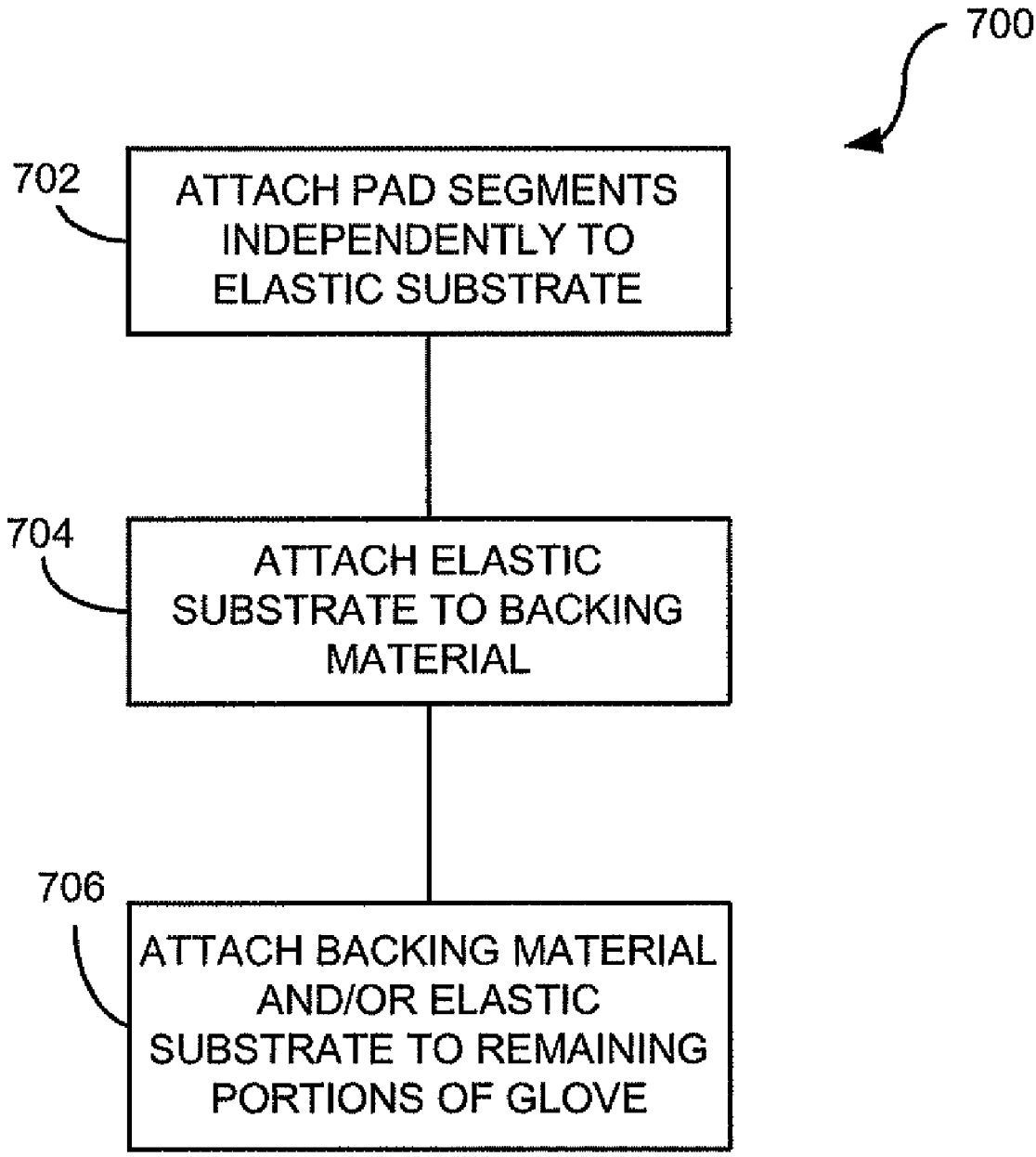
FIG. 7 is a flow chart illustrating an exemplary method for manufacturing a protective glove, according to an embodiment of the present invention.

A further embodiment of the present invention provides a method 700 for manufacturing a protective glove having independent pads, as shown in FIG. 7. With continuing reference to FIGS. 3, 4, and 7, method 700 begins in step 702 by attaching pad segments 300 independently to elastic substrate 320. In this example, pad segments 300 are attached by their ends 306A and 306B, which are separately attached to elastic substrate 320. After pad segments 300 are attached to elastic substrate 320, the method continues in step 704 by attaching elastic substrate 320 to backing material 310, either over an opening in backing material 310 (as in FIGS. 3 and 6A) or over backing material 310 itself (as in FIG. 6B). Elastic substrate 320 can be attached to backing material 310 by, for example, a point attachment (e.g., stitching, rivets, or staples) or by a continuous attachment (e.g., spray adhesive). In step 706, the backing material 310 and/or elastic substrate 320 are/is attached to the remaining portions of the glove, such as a gusset or liner for the front (e.g., palm) of the hand and a cuff to protect the wrist.

Figure 8:
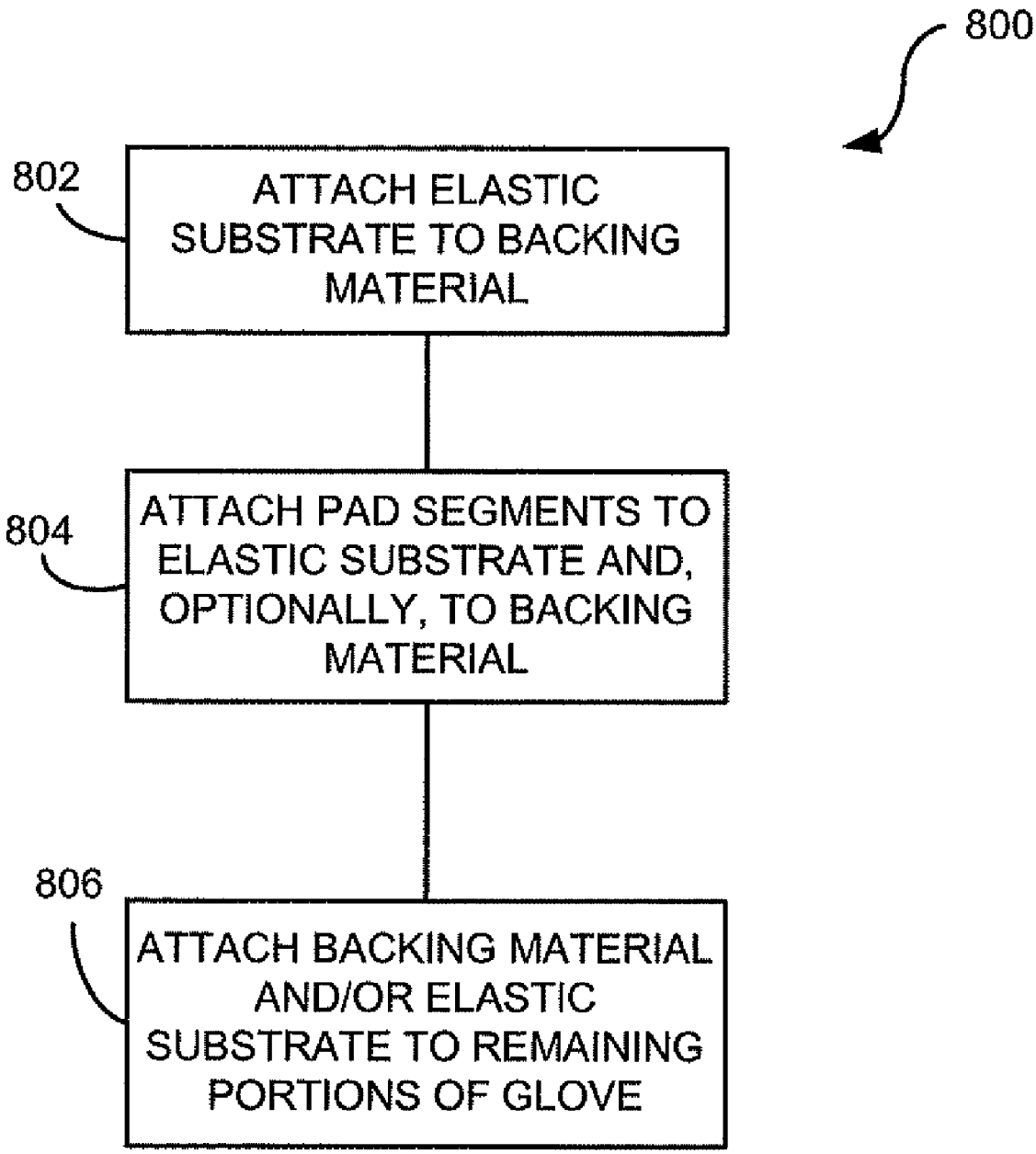
FIG. 8 is a flow chart illustrating another exemplary method for manufacturing a protective glove, according to an alternative embodiment of the present invention.

FIG. 8 shows an alternative method 800 for manufacturing a protective glove having independent pads. As shown in this embodiment, method 800 begins in step 802 by attaching elastic substrate 320 to backing material 310 by, for example, a point attachment or a continuous attachment. In step 804, the pad segments 300 are independently attached to elastic substrate 320. Pad segments 300 can also be attached to backing material 310 if elastic substrate 320 is disposed over backing material 310 itself (as in FIG. 6B) as opposed to over an opening in backing material 310 (as in FIGS. 3 and 6A). Pad segments 300 could be attached only to elastic substrate 320 by using, for example, a continuous attachment means such as spray adhesive, compression molding, or high frequency welding. Pad segments 300 could be attached to both elastic substrate 320 and backing material 310 by, for example, stitching disposed through pad segments 300, elastic substrate 320, and backing material 310. In step 806, the backing material 310 and/or elastic substrate 320 are/is attached to the remaining portions of the glove.

Optionally, for both methods 700 and 800, before pad segments 300 are attached to elastic substrate 320, ventilation holes 404 can be formed in elastic substrate 320. Similarly, before elastic substrate 320 is attached to backing material 310, holes can optionally be formed in backing material 310, which preferably are generally aligned with holes 404 of elastic substrate 320.

Although the present invention has been described in the context of lacrosse, one of ordinary skill in the art would appreciate that the present invention is applicable to other activities requiring hand protection, such as ice hockey, motorcross, skiing, snowboarding, bicycling, cricket, and field hockey. Thus, notwithstanding the particular benefits associated with applying the present invention to lacrosse gloves, the present invention should be understood to be broadly applicable to any protective glove.

Although embodiments of the present invention presented above describe a particular construction for the pad segments, one of ordinary skill in the art would appreciate that other forms of protective layers could be fastened to the elastic substrate and provide similar benefits. For instance, pad segments that are formed of a compression, injection, cast, or blow molded plastic in the shape of a back of a hand could serve as the protective layer that is attached to the elastic substrate. The molded pad segments could be one or more pieces affixed to the elastic substrate. For this reason, notwithstanding the particular benefits of the pad segment construction described herein, the present invention should be considered broadly applicable to any protective layer attached to an elastic substrate.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A protective glove comprising:

an elastic substrate comprising a unitary piece of material disposed on a back-hand portion of the protective glove;

a first pad segment attached to the elastic substrate at one or more first attachment points on the elastic substrate;

a second pad segment attached to the elastic substrate at one or more second attachment points on the elastic substrate; and a first outer cover disposed over the first pad segment; and a second outer cover disposed over the second pad segment, the first outer cover and the second outer cover not being attached to each other, the first outer cover and the second outer cover being substantially non-elastic, wherein the first pad segment is spaced apart a distance from the second pad segment, wherein the one or more first attachment points are different from the one or more second attachment points, and wherein the first pad segment and the second pad segment are elastically coupled by the elastic substrate such that, as the elastic substrate stretches, the first pad segment and the second pad segment can move in different directions and the distance between the first pad segment and the second pad segment can vary.

2. The protective glove of claim 1, wherein when the elastic substrate, the first pad segment, and the second pad segment are viewed in cross-section:

the first pad segment is attached to the elastic substrate at a first end of the first pad segment and at a second end of the first pad segment opposite to the first end, and the second pad segment is attached to the elastic substrate at a first end of the second pad segment and at a second end of the second pad segment opposite to the first end, and wherein the second end of the first pad segment is adjacent to the first end of the second pad segment.

3. The protective glove of claim 1, wherein the first pad segment comprises a first pad core, wherein the first outer cover is attached to the elastic substrate at the one or more first attachment points, and wherein the second pad segment comprises a second pad core, wherein the second outer cover is attached to the elastic substrate at the one or more second attachment points.

4. The protective glove of claim 3, wherein the first pad segment further comprises a rigid inner cover disposed between the first pad core and the first outer cover.

5. The protective glove of claim 3, wherein the first pad core comprises one of an ethylene vinyl acetate, a foam, an air chamber, and a gel.

6. The protective glove of claim 1, wherein the one or more first attachment points comprise a first stitching and the one or more second attachment points comprise a second stitching.

7. The protective glove of claim 1, wherein the elastic substrate is disposed in an area of the protective glove intended to protect at least one of a forearm, a wrist, a back of a hand, a finger, and a thumb of a user wearing the protective glove.

8. The protective glove of claim 1, wherein the elastic substrate comprises a mesh material.

9. The protective glove of claim 1, wherein the elastic substrate defines ventilation openings.

10. The protective glove of claim 1, wherein the first pad segment comprises a unitary piece of molded plastic.

11. The protective glove of claim 1, further comprising a backing material, wherein the elastic substrate is attached to the backing material.

12. The protective glove of claim 11, wherein the backing material defines an opening, and wherein the elastic substrate spans the opening in the backing material.

13. The protective glove of claim 12, wherein the first pad segment and the second pad segment are disposed over the opening.

14. The protective glove of claim 12, wherein the elastic substrate is stitched to the backing material by a line of stitching substantially around the perimeter of the elastic substrate and the perimeter of the opening in the backing material.

15. The protective glove of claim 12, wherein the elastic substrate is disposed within the opening such that the elastic substrate is co-extensive with the backing material when the elastic substrate and the backing material are viewed in cross-section.

16. The protective glove of claim 12, wherein the opening is disposed in an area of the protective glove intended to protect a back of a hand and a back of a thumb of a user wearing the protective glove.

17. The protective glove of claim 11, wherein the backing material defines a first ventilation hole and the elastic substrate defines a second ventilation hole, and wherein the first ventilation hole and the second ventilation hole are aligned with each other.

18. The protective glove of claim 17, wherein the first pad segment comprises a pad core and a pad outer cover, wherein the pad outer cover defines a third ventilation hole, and wherein the first, second, and third ventilation holes are aligned with each other.

19. The protective glove of claim 11, wherein the elastic substrate is layered over the backing material, wherein the elastic substrate is continuously attached to the backing material, and wherein the backing material is stretchable.

20. A method for manufacturing a protective glove comprising:

providing an elastic substrate comprising a unitary piece of material on a back-hand portion of the protective glove;

attaching a first pad segment to the elastic substrate at one or more first attachment points on the elastic substrate;

attaching a second pad segment to the elastic substrate at one or more second attachment points on the elastic substrate;

attaching a first outer cover over the first pad segment; and attaching a second outer cover over the second pad segment, the first outer cover and the second outer cover not being attached to each other, the first outer cover and the second outer cover being substantially non-elastic, wherein the first pad segment is spaced apart a distance from the second pad segment, wherein the one or more first attachment points are different from the one or more second attachment points, and wherein the first pad segment and the second pad segment are elastically coupled by the elastic substrate such that, as the elastic substrate stretches, the first pad segment and the second pad segment can move in different directions and the distance between the first pad segment and the second pad segment can vary; and attaching the elastic substrate to a remaining portion of the protective glove.

21. The method of claim 20, wherein attaching the elastic substrate to the remaining portion of the glove comprises:

attaching the elastic substrate to a backing material; and attaching the backing material to the remaining portion of the protective glove.

22. The method of claim 21, further comprising defining a first ventilation hole in the elastic substrate and a second ventilation hole in the backing material, wherein the first ventilation hole and the second ventilation hole are aligned.

* * * * *